US008517122B2

(12) United States Patent
Lowry

(10) Patent No.: US 8,517,122 B2
(45) Date of Patent: Aug. 27, 2013

(54) AIR/WATER SEPARATOR AND METHODS OF USE THEREOF

(75) Inventor: Jacob Garth Lowry, Rutherford (AU)

(73) Assignee: Cardinal Trading Company Pty Ltd. (AU)

( * ) Notice: Subject to any disclaimer, the term of this patent is extended or adjusted under 35 U.S.C. 154(b) by 555 days.

(21) Appl. No.: 12/663,213

(22) PCT Filed: Jun. 4, 2008

(86) PCT No.: PCT/AU2008/000804

§ 371 (c)(1),
(2), (4) Date: Jun. 9, 2010

(87) PCT Pub. No.: WO2008/148158

PCT Pub. Date: Dec. 11, 2008

(65) Prior Publication Data

US 2010/0258353 A1 Oct. 14, 2010

Related U.S. Application Data

(60) Provisional application No. 60/941,719, filed on Jun. 4, 2007.

(30) Foreign Application Priority Data

Jun. 4, 2007 (AU) ..... 2007903006

(51) Int. Cl.

| | |
|---|---|
| ***C09K 8/02*** | (2006.01) |
| ***E21B 21/12*** | (2006.01) |
| ***E21B 21/14*** | (2006.01) |

(52) U.S. Cl.

CPC ..... *E21B 21/12* (2013.01); *E21B 21/14* (2013.01)

USPC ..... 175/205; 175/312; 175/393; 175/69; 175/337

(58) Field of Classification Search

USPC ..... 175/205, 312, 324, 393, 69, 339, 175/337; 55/396, 397, 398, 463, 468, 455; 96/204, 206, 212, 214, 220

See application file for complete search history.

(56) References Cited

U.S. PATENT DOCUMENTS

| | | | |
|---|---|---|---|
| 2,503,481 | A | 4/1950 | Hallinan |
| 2,873,092 | A | 2/1959 | Dwyer |

(Continued)

FOREIGN PATENT DOCUMENTS

| | | | |
|---|---|---|---|
| EP | 0107475 | B1 | 12/1988 |
| EP | 1375817 | B1 | 1/2004 |

*Primary Examiner* — Cathleen Hutchins

(74) *Attorney, Agent, or Firm* — Mark S. Cohen; Pearl Cohen Zedek Latzer, LLP

(57) ABSTRACT

A drill and a separator apparatus and a method of prolonging bearing life are described, the separator apparatus being suitable for separating an air/water mixture into discrete air and water streams during drilling of a blast hole. The separator apparatus includes a separator body which is adapted to be installed at a distal or lower region of a drill string and when installed at the distal or lower region forms one or more separation chambers or reservoirs, each separation chamber or reservoir comprising an inlet adapted to receive the air/water mixture, a first outlet in fluid communication with a drill bit for releasing air thereto and a second outlet in fluid communication with a wall of the blast hole and disposed in the distal or lower region of the drill string to release water separated from the air/water mixture in a region adjacent the drill bit. The one or more first outlets for releasing air from the or each separation chamber is disposed at an upper region of the or each separation chamber and the one or more second outlets is disposed at a lower region of the or each separation chamber for releasing water from the or each separation chamber so that when in use water is inhibited from egress from the or each separation chamber through the or each first outlet.

23 Claims, 8 Drawing Sheets

(56) References Cited

U.S. PATENT DOCUMENTS

| | | | | |
|---|---|---|---|---|
| 2,879,846 | A | 3/1959 | Dawson, Jr. | |
| 2,920,872 | A | 1/1960 | Baur et al. | |
| 4,194,567 | A * | 3/1980 | Marais | 166/311 |
| 4,428,442 | A * | 1/1984 | Steinke | 175/228 |
| 4,932,005 | A | 6/1990 | Birdwell | |
| 5,682,957 | A * | 11/1997 | Lyon | 175/100 |
| 6,206,110 | B1 | 3/2001 | Slaughter, Jr. et al. | |
| 6,227,316 | B1 | 5/2001 | Rohde | |
| 2005/0247487 | A1 | 11/2005 | Mellott | |
| 2007/0062374 | A1 * | 3/2007 | Kolle | 96/217 |
| 2007/0187152 | A1 | 8/2007 | Brodie et al. | |

* cited by examiner

AIR/WATER SEPARATOR AND METHODS OF USE THEREOF

CROSS-REFERENCE TO RELATED APPLICATIONS

This application is a National Phase Application of PCT International Application PCT/AU2008/000804, filed Jun. 4, 2008, claiming priority to U.S. Provisional Patent Application 60/941,719, filed Jun. 4, 2007, and Australian Patent Application 2007903006, filed Jun. 4, 2007, all of which are incorporated by reference herein in their entirety.

FIELD OF THE INVENTION

The present invention relates generally to an apparatus for use in drilling applications and in particular, while drilling rotary blast holes.

BACKGROUND TO THE INVENTION

During normal drilling operations an air/water mixture stream is delivered to a drill bit through hollow drill pipes and other components, the mixture being fed via a porting arrangement incorporated into the attached drill bit. The air/water mixture stream clears drilled earth (known as the chip), provides cooling to the bearings in the drill bit, and reduces air borne dust as the chip leaves the hole during drilling operations.

One disadvantage to the process is that the air/water fluid dramatically reduces bearing life and therefore bit life. It is also noteworthy that mine sites often use recycled water that commonly contains corrosive minerals amplifying the detrimental effect of the water.

The present invention seeks to ameliorate one or more of the above-mentioned disadvantages.

SUMMARY OF THE INVENTION

According to one aspect of the present invention there is provided a separator apparatus suitable for separating an air/water mixture into discrete air and water streams during drilling of a blast hole, the separator apparatus including a separator body which is adapted to be installed at a distal or lower region of a drill string and when installed at the distal or lower region forms one or more separation chambers or reservoirs, each separation chamber or reservoir comprising an inlet adapted to receive the air/water mixture, a first outlet in fluid communication with a drill bit attachment region for releasing air thereto and a second outlet in fluid communication with a wall of the blast hole and disposed in the distal or lower region of the drill string to release water separated from the air/water mixture in a region adjacent the drill bit attachment region.

According to another aspect of the present invention there is provided a separator apparatus suitable for separating an air and water mixture into discrete air and water streams during drilling the separator apparatus including a separator body which is adapted to be installed at a distal region of a drill and when installed at the distal region forms one or more separation chambers, the or each separation chamber including one or more inlet ports for introducing the air and water mixture into the or each separation chamber, and one or more first outlets for releasing air from the or each separation chamber disposed at an upper region of the or each separation chamber and one or more second outlets disposed at a lower region of the or each separation chamber for releasing water from the or each separation chamber so that when in use water is inhibited from egress from the or each separation chamber through the or each first outlet.

According to yet another aspect of the present invention there is provided a separator apparatus suitable for separating an air and water mixture into discrete air and water streams during drilling the separator apparatus including a separator body which is adapted to be installed at a distal region of a drill and when installed at the distal region forms one or more separation chambers, the or each separation chamber including one or more inlet ports for introducing the air and water mixture into the or each separation chamber, and one or more first outlets disposed at a radially inward region of the or each separation chamber for releasing air from the or each separation chamber and one or more second outlets disposed at a radially outward region of the or each separation chamber for releasing water from the or each separation chamber so that when in use the water is inhibited from egress from the or each separation chamber through the or each first outlet.

According to still another aspect of the present invention there is provided a separator apparatus suitable for separating an air and water mixture into discrete air and water streams during drilling, the separator apparatus including: a separator body which is adapted to be installed at a distal region of a drill and when installed at the distal region forms one or more separation chambers, the or each separation chamber including one or more inlet ports for introducing the air and water mixture into the or each separation chamber, and one or more first outlets disposed at an upper and radially inward portion of the or each separation chamber for releasing a discrete air stream from the or each separation chamber and a second outlet disposed at a lower and radially outward portion of the or each separation chamber for releasing a discrete water stream from the or each separation chamber so that when in use water is inhibited from egress from the or each separation chamber through the or each first outlet.

According to a yet further aspect of the present invention there is provided a drill pipe which includes an outlet for releasing water or other fluid under pressure through an aperture; a variable adjustment means associated with the outlet, the variable adjustment means being movable from a closed position to an open position to vary the aperture size. The arrangement is such that varying the aperture size varies the water flow through the aperture, and at the same time changing the back pressure within the drill pipe.

According to a still further aspect of the present invention there is provided an adjustment means for adjusting an outlet mounted on a drill pipe, the adjustment means movable from a closed position to an open position to vary the outlet size.

According to a yet other aspect of the present invention there is provided a drill which includes a separator for separating an air and water mixture into discrete air and water streams during drilling, the separator apparatus including one or more separation chambers which include one or more inlets for introducing the air and water mixture into the separation chamber, and a plurality of outlets, a first outlet being a water outlet and disposed at a distal region of a drill pipe, and a second outlet being an air outlet which is disposed upwardly and/or radially inwardly of the water outlet so that water is inhibited from entry into the air outlet during operation of the drill.

In a preferred embodiment the separation chamber is an annular chamber disposed in a peripheral region of the drill pipe, and between an inner wall of the drill pipe and an outer wall of a neck region of a separator core. The first outlet is preferably a water outlet which is preferably disposed at a base region of the separation chamber and the air outlet is a port disposed at an upper axial region relative thereto. The inlets are disposed at peripheral regions of the separator and in use introduce an atomised mix of air and water into the separation chamber. Without wishing to be bound by theory, it is believed that the atomised mixture is reduced in velocity upon reaching the or each separation chamber and the water is converted into a droplet form. The droplets have a density greater than that of the water in the atomised mixture and tend to be drawn to the base of the chamber where they are ejected through the water outlet. The air on the other hand tends to quickly separate from the water and, partly because of its lower density relative to the water droplets, moves toward the upper regions of the separation chamber and through the secondary or air outlet. When in use, the drill pipe and separation chamber rotate at approximately 120 to 140 rpm, which tends to draw the water droplets to the outside of the drill pipe and the air to the axial part of the drill. Therefore, the air tends to move towards the axially positioned air outlet and down an axial air outlet passage, which facilitates the separation of the water and air.

Preferably the inlet is in the form of an inlet port so as to simplify the construction of the separator body. Preferably a constriction or venturi is provided at an entrance to the inlet so as to increase the velocity of the air and water mixture before entry into the separation chamber. This facilitates spin off of the water droplets.

Preferably the first and second outlets are respectively, air and water outlets which are in the form of ports to simplify construction of the separator apparatus.

Preferably a nozzle is provided at the water outlet port so as to atomise the water issuing from the water outlet port.

Preferably the water outlet includes a variable adjustment means moveable from a closed position to an open position to vary the size of the water outlet port. Preferably the variable adjustment means includes a plug movable relative to a flange having one or more features or faces corresponding with the plug. Preferably the water outlet port includes an aperture which is in the form of a space around the plug, being generally annular in shape. In preferred embodiments the variable adjustments means is threaded and is integral with the atomising nozzle so as to securely advance and retrace relative to the flange. Preferably the threaded nozzle is mounted in a side wall of the drill pipe.

The advantage of the atomising nozzle in use is so that water enters the drill hole in an atomised condition to improve hole stand-up.

Preferably the inlet is disposed at an upper annular region of the separator apparatus. This is to facilitate air and water mixture entry into the separation chamber and to reduce pressure loss upon entry into the separation chamber.

Preferably the air outlet is in the form of an air outlet port and is disposed in an axial region of the separation chamber so that in use, when the drill pipe is rotating, water entry to the air outlet port is inhibited.

Preferably a venturi is provided at an entrance to the air outlet port so as to increase the velocity of the air entering the air outlet port, and to further inhibit any water which may be heading towards the air outlet port. Without wishing to be bound by theory, it is believed that the greater the velocity of the water droplets, the greater the tendency for it to have a tangential component which will be increased and therefore tends to move the water droplets to the peripheral region of the separation chamber and away from the air outlet port while the drill is spinning.

Preferably the separation is generally annular and disposed between an inner periphery of the drill pipe and outwardly facing walls of the separator body. Preferably the separator body includes a core which includes neck walls. It is preferably the neck walls which are the outwardly facing walls which form an inner periphery of the separation chamber.

Preferably the separator body includes connector regions, at one end to connect to the drill pipe and at the other to connect to a drill. At the one end, a core body is provided to connect to the drill pipe at the distal end of the drill pipe. Preferably the core body includes core segments which operatively engage with the distal end of the drill pipe. Preferably, the core segments are generally of a diameter similar to that of the inner diameter of the drill pipe, so that an interference fit is provided to operatively engage the drill pipe. In one embodiment two core segments are provided, diametrically opposed to one another.

Preferably parts of the separation chamber are disposed in regions between shoulders of the core segments so as to assist with imparting a tangential velocity to the water droplets.

Preferably the connector region at the second end is a threaded bore so as to receive a drill bit. Preferably the air outlet passage, axially disposed, is in fluid communication with the threaded bore so that the air may lubricate the bearings of the drill bit.

According to a still yet further aspect of the present invention, there is provided a method of separating an air and water mixture into discrete air and water streams during drilling a blast hole, the method including the steps of: introducing the air/water mixture into a separation chamber; reducing the velocity of the air/water mixture to form water droplets; forcing the water droplets into a portion of the chamber adjacent a water outlet; and releasing the air from the chamber or reservoir through an air outlet disposed in a remote portion of the separation chamber or reservoir.

In one arrangement the air outlet ports include hoods or cowls which in some embodiments extend below or distal the inlet ports so as to further inhibit water entry thereto. In those embodiments the hoods or cowls extend from the inner walls of the separation chambers to form the connector regions which engage with the inner walls of the drill string. In some arrangements the air/water mixture in use is directed outwardly by a nacelle which is mounted generally centrally on the separator body.

BRIEF DESCRIPTION OF THE DRAWINGS

In order to enable a clearer understanding of the invention, it will now be described with reference to the attached drawings, and in those drawings.

DETAILED DESCRIPTION OF THE INVENTION

Figure 1:
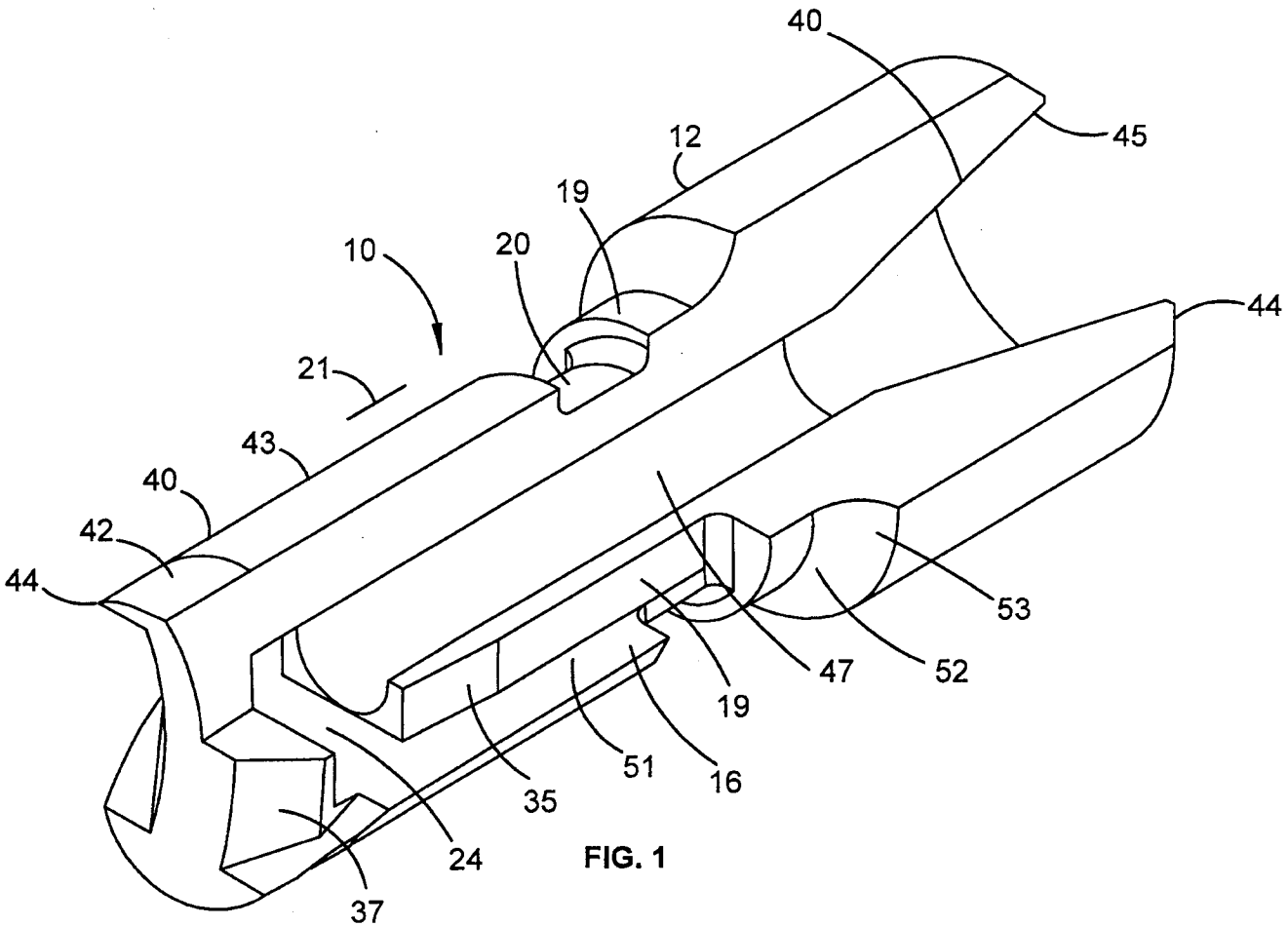
FIG. 1 is a cut away view of a separator apparatus of a first embodiment of the present invention showing various inner features of a separator body for clarity.
Figure 2:
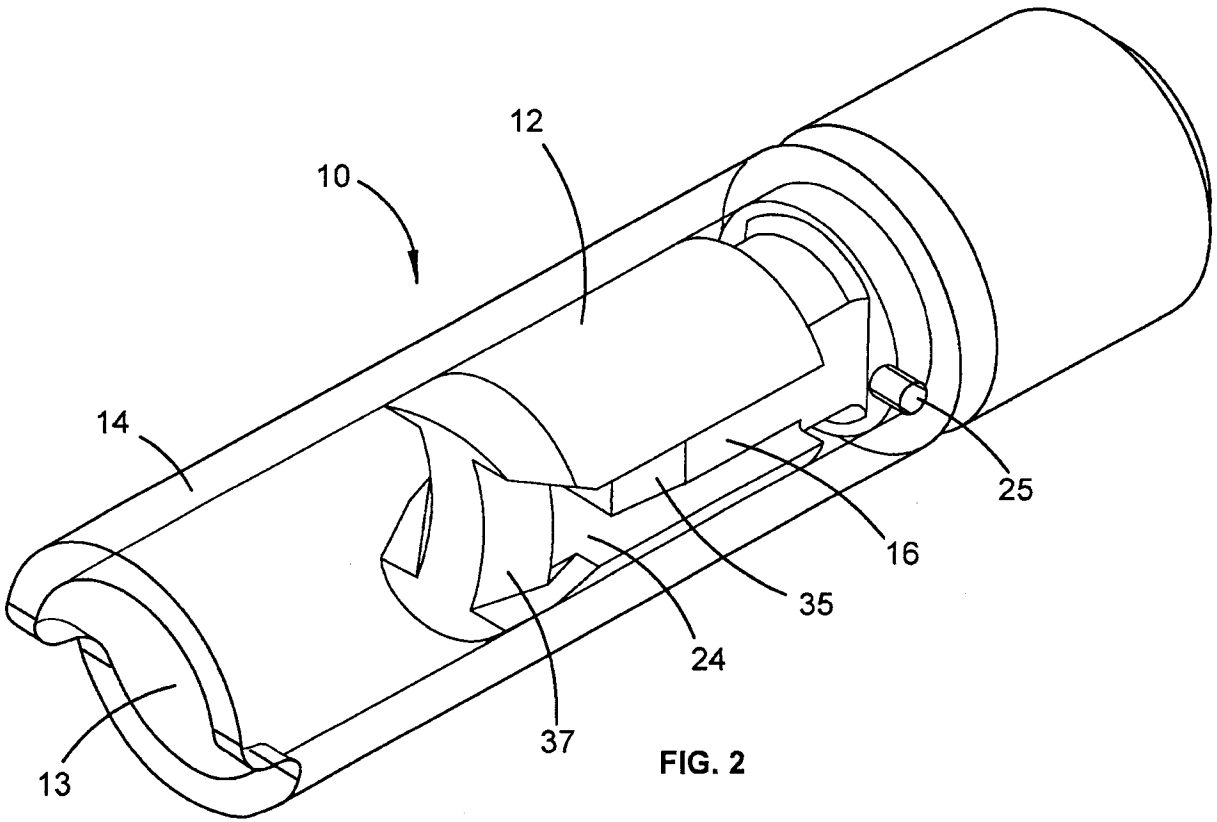
FIG. 2 is an assembled isometric view of the separator apparatus of FIG. 1.
Figure 3:
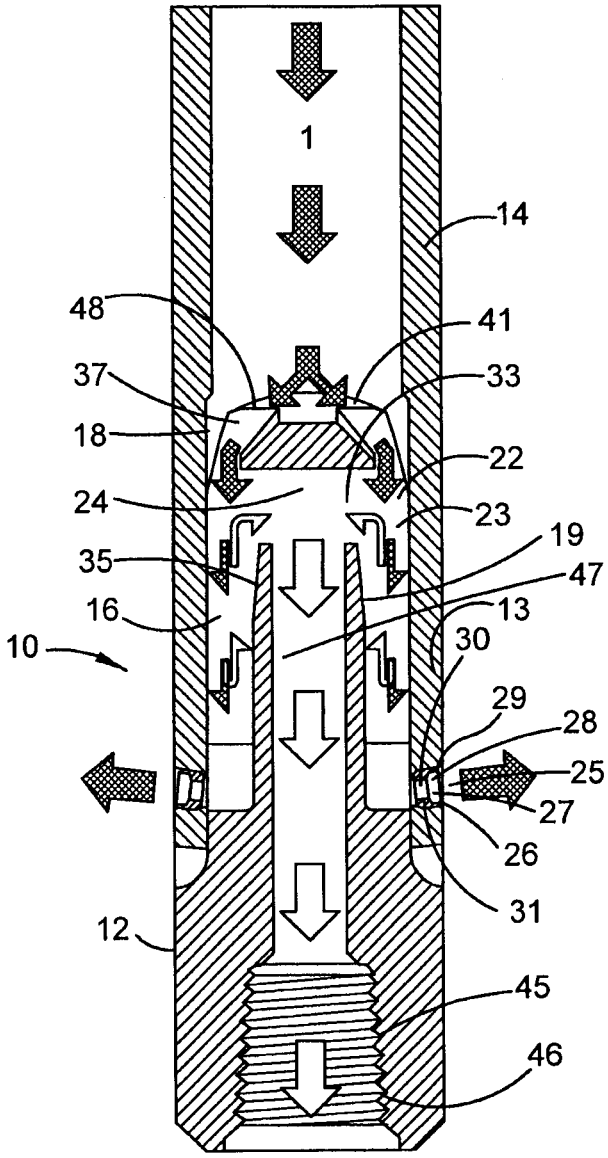
FIG. 3 is a section view of the separator apparatus of FIG. 1.

Referring to FIG. 1-3 there is provided a first embodiment of separator apparatus generally indicated at 10, the separator apparatus 10 including a separator body 12 adapted to be mounted at a distal end region 13 of a drill pipe 14. When assembled, the separator apparatus includes a separation chamber 16 which is disposed between an inner peripheral wall 18 of the drill pipe 14 and outwardly facing walls 19 of the separator body 12. The outwardly facing walls 19 are necked walls 20 of a core section of the separator body 21 so as to form at least a part-annular separation chamber or reservoir at an outer periphery of the separator body 12.

The separation chamber 16 includes inlets 22 disposed at an upper region 23 of the at least part-annular separation chamber which inhibits pressure loss upon introduction of air/water mixture 1 and to facilitate water movement to an outer periphery of the annular separation chamber 23 which inhibits its exit through air outlet 24.

The separation chamber 16 further includes an outlet 25 in the form of a water outlet port 26 which is disposed in the drill pipe at the distal end 13 so as to inhibit dust egress from the hole (not shown). The water outlet port 26 includes an adjustable means 27 in the form of an adjustable nozzle 28 which is moveable from a closed position to an open position to vary the size of an aperture 29. The adjustable nozzle 28 includes a plug 30 which is movable relative to a flange 31 which has one or more corresponding faces against which it may abut to close the aperture 29. Water may flow around the plug into the aperture 29 which is annular. The adjustable nozzle 28 is an atomising nozzle so as to facilitate hole stand-up during drilling. The air outlet 24 is disposed at the upper or proximal end of the annular separation chamber 23 so as to inhibit water flow into the air outlet 24. The outlet 25 is also disposed in an axial region of the separator body 12 and separation chamber 16 so as to further inhibit water flow into the outlet 24. The outlet 24 is in the form of an air outlet port 33 so as to reduce cost of manufacture and simplicity of operation. A venturi 35 is provided at the entrance to the air outlet 24 so as to accelerate any air and water which may be approaching the outlet 24, so as to facilitate the spinning off of the water to the outer periphery 18 of the separation chamber 16, which inhibits entry of water to air outlet chamber or passage 47.

Immediately upstream of the inlet port 22 is a constriction or venturi 37 so as to increase the velocity of the air water mixture 1. The venturi 37 facilitates reduction of velocity upon entry of the air water mix 1 into the separation chamber 16 so as to increase the density of the water upon entry to the separation chamber 16 which facilitates its separation from the air.

Connecting means 40 are provided at each end of the separator body 12. At an upper end 41, a core body 42 is provided which includes core segments 43 which are of a similar diameter to the internal bore 18 of the drill pipe 14, so as to operatively engage thereto with an interference fit. At the lower end 44 a drill connector region 45 is provided which is threaded with threads 46 so as to threadably receive the drill bit (not shown).

The air outlet chamber or passage 47 is provided in an axial region of the separator body 12 within the core 43 and is in fluid communication with the connector region 45 and the drill bit so as to lubricate the bearings and to facilitate chip removal from the cutting face of the drill bit.

A deflector 48 is provided at the upper end 41 of the separator body and incorporates the venturies 37. The deflector 48 deflects the air water mix 1 to the outer peripheral regions 18 of the separation chamber 16 so as to inhibit water flow down the air outlet passage 47 in use.

The separation chamber 16 of the first embodiment is in two parts, upper or proximal 51 and lower or distal 52. The upper or proximal separation chamber 51 is disposed between two core segments 43 and the lower or diatal one, 52, is a full annular section 53 which in use mainly holds water only.

Figure 4:
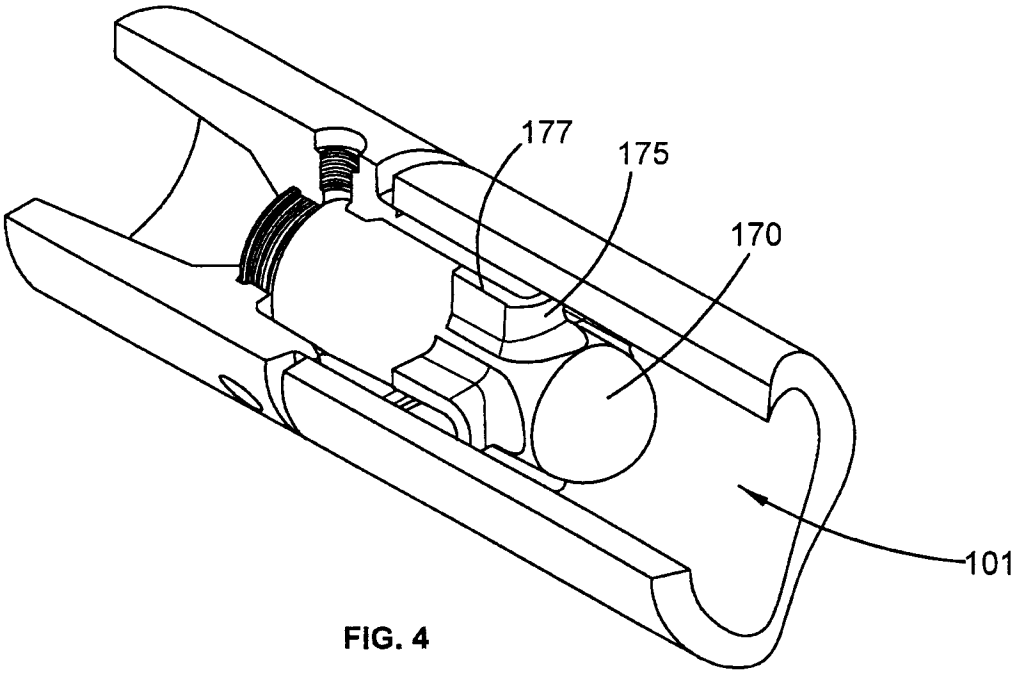
FIG. 4 is a cutaway isometric view of a separator apparatus of a second embodiment of the present invention.
Figure 5:
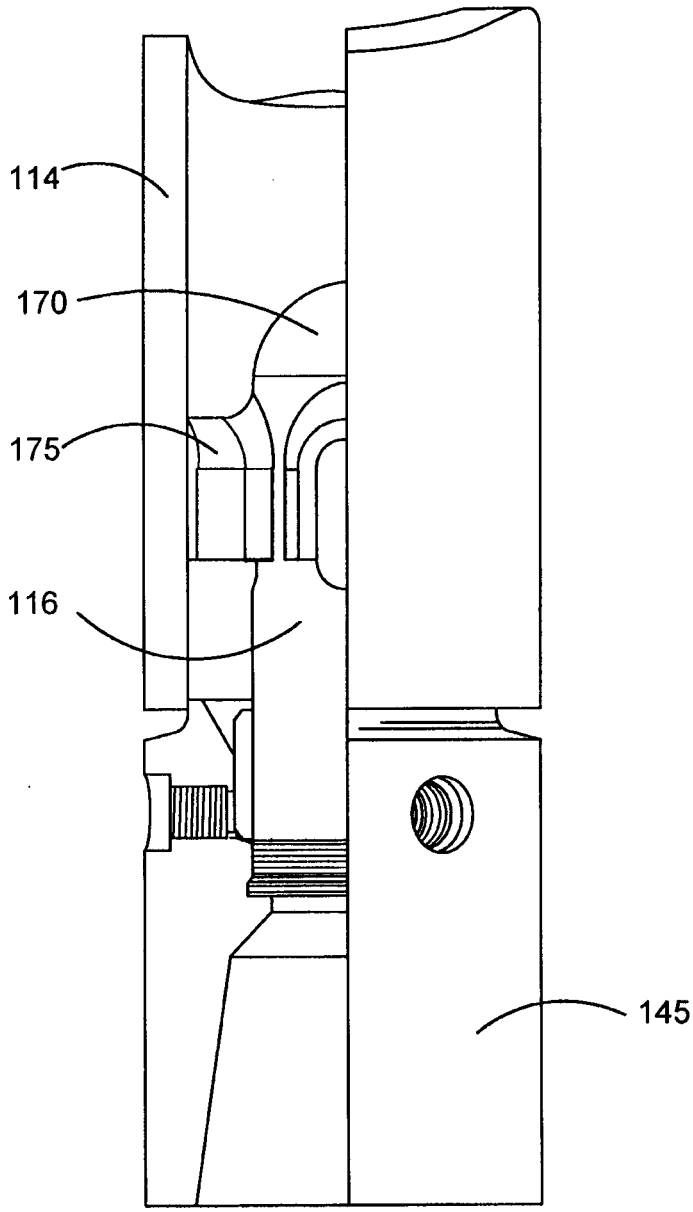
FIG. 5 is a cutaway side elevation view of the separator apparatus of FIG. 4.
Figure 6:
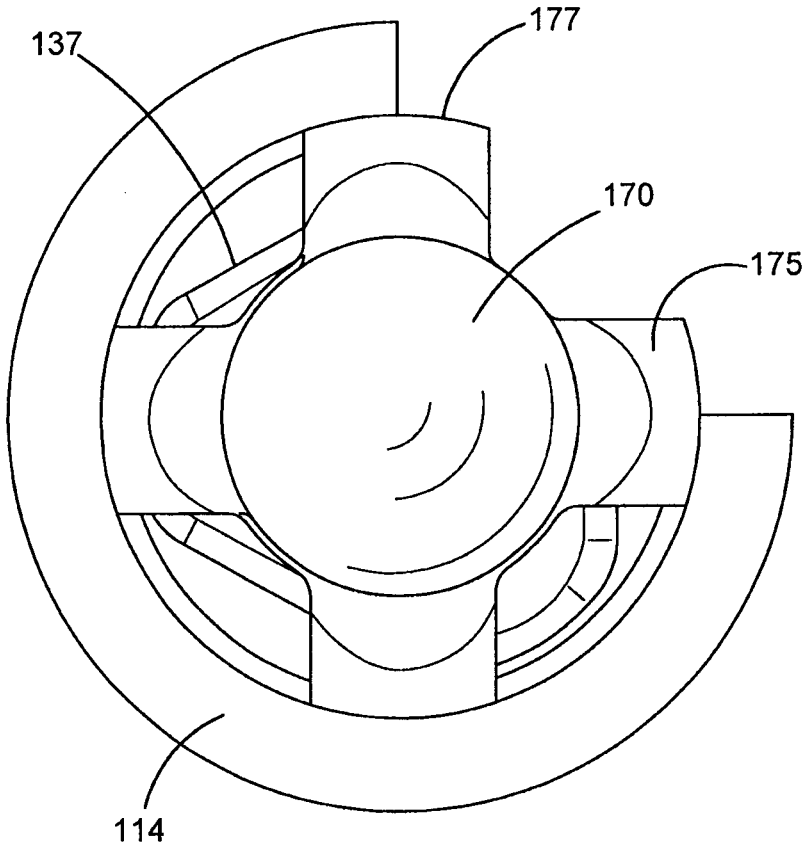
FIG. 6 is an end elevation view of the separator apparatus of FIG. 4.
Figure 7:
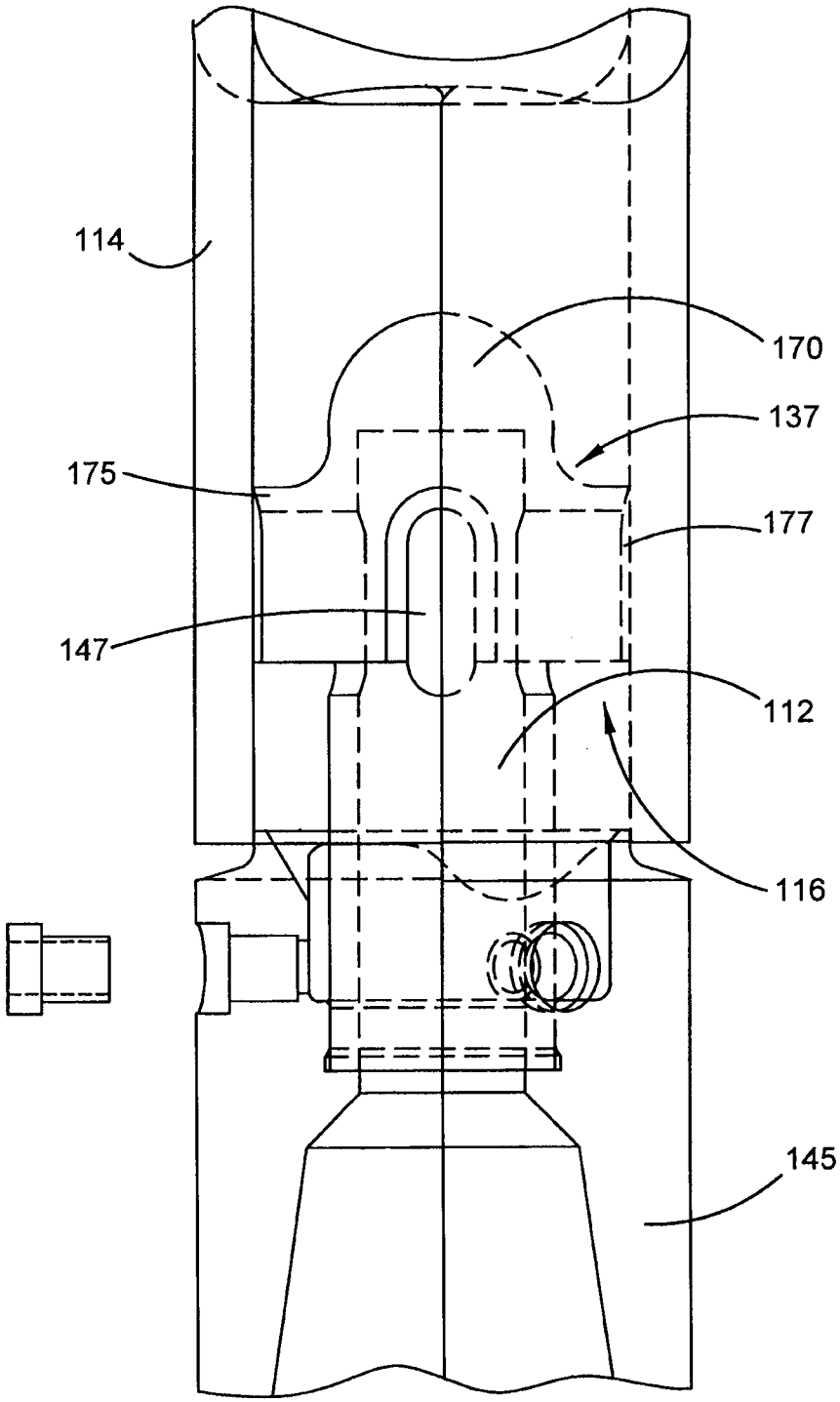
FIG. 7 is a side elevation cutaway view of the separator apparatus of FIG. 4.
Figure 8:
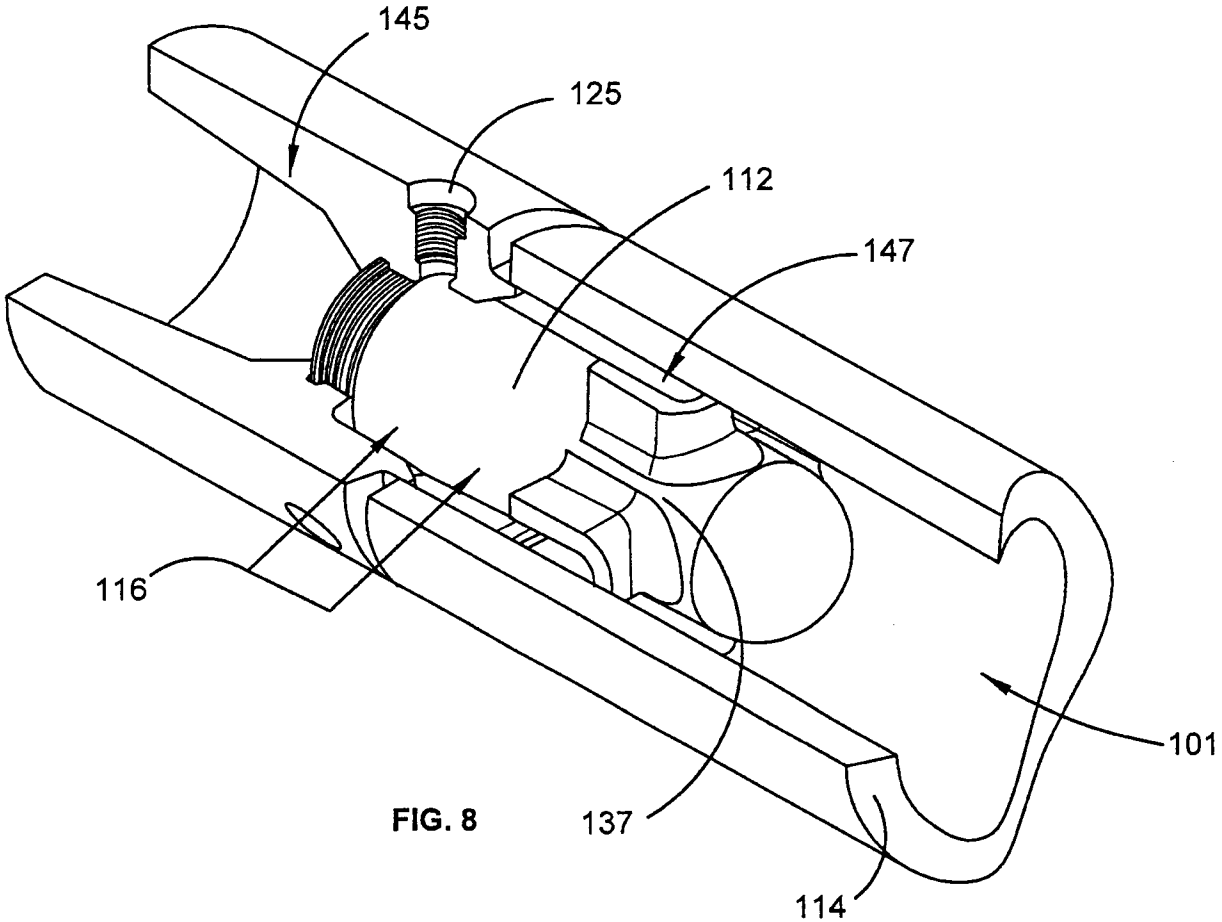
FIG. 8 is a similar view of the second embodiment to that shown in FIG. 4.

Referring to FIGS. 4-6 there is shown a second embodiment of separator apparatus. Like numerals on these Figures reflect features like to those described and shown in FIGS. 1-3. Therefore, the separator apparatus is generally indicated at 110 and a separator body is shown at 112. The description of the second embodiment herein will be limited to points of structural difference from those described in FIGS. 1-3.

Thus, a nacelle is shown at 70 which directs the air/water mixture 101 to an outer periphery of the drill pipe, into the annular separation chamber 116 and away from the air outlet port 147. Hoods or cowls 175 are provided, the walls of which extend down in the distal direction to inhibit water from entry to the outlet port 147. The hoods 175 extend outwardly to provide a connection region at their ends 177 in the form of an interference fit. The separator body 112 includes a connection region 140 at its distal end so as to connect a drill bit connector body 145. The drill bit connector body also seals the end of the drill pipe.

In the second embodiment the water outlet port 125 is disposed not in the wall of the drill pipe 114 but in the wall of the drill bit connector body 145. This is functionally similar to the first embodiment because it clearly puts a fluid communicator between the separation chamber 116 and the inner wall of the blast drill hole.

In operation an atomised air and water mix 1 in an air:water ratio of approximately (35 l/m:2,500 cfm) is fed under pressure down the bore of a drill pipe 14 which, when it reaches the distal end 13 of the drill string or pipe hits a deflector 48 and travels along venturies 37 into inlet 22. The drill pipe 14 is rotating throughout the process at approximately 120 to 140 rpm and a drill bit (not shown) is cutting a hole in the earth, suitable for receiving explosive charges. The air/water mix 1 accelerates along the venturi 37 and enters the separation chamber 16 which is of a larger volume than the inlet port 22. Consequently the velocity of the air/water mix 1 is reduced and water droplets form. Without wishing to be bound by theory, it is believed that the density of the water droplets increase relative to the atomised form of the water and rotation of the water is facilitated because it is pushed by the shoulders of the narrow upper or proximal chamber 51 of the separation chamber 16. The water droplets are thereby encouraged to the outside of the separation chamber 16 and because of the greater density of the water and the pressure it is under, the water droplets are generally forced downwards (or to distal end) and radially outwards to the base outer portions of the separation chamber 16. The water then is ejected through outlet 24 to boost hole standup. The water is inhibited from exiting through air outlet 47 by pressure, rotation of the drill string, and by the venturi 35. Water in the air outlet 47 reduces bearing life of the drill bit mounted in region 45/46.

The air, being far less dense than the water droplets, and also being under pressure, is forced generally upwards and inwards towards the upper axially disposed air outlet port 24 and down the central air outlet chamber or passage 47 and then into the drill bit bearings and cutting faces. Some air is used to facilitate atomisation of the water through the adjustable outlet passage 27, but generally this is only of the order of 60 cfm. The majority of air is sent down the central air outlet passage 47 to lubricate bearings and facilitate chip removal from drill teeth.

Finally, it is to be understood that various alterations, modifications and/or additions may be incorporated into the various constructions and arrangements of parts without departing from the spirit or ambit of the invention.

The claims defining the invention are as follows:

1. A separator apparatus suitable for separating an air/water mixture into discrete air and water streams during drilling of a blast hole, the separator apparatus including a separator body which is adapted to be installed at a distal or lower region of a drill string and when installed at the distal or lower region forms a separation chamber comprising an inlet adapted to receive the air/water mixture, a first outlet in fluid communication with a drill bit attachment region for releasing air thereto and one or more second outlets in fluid communication with a wall of the blast hole and disposed in the distal or lower region of the drill string to release water separated from the air/water mixture in a region adjacent the drill bit attachment region, wherein the one or more second outlets include a variable adjustment means to vary the size of the second outlet and hence air pressure at the drill bit attachment region, wherein the separation chamber is an annular chamber disposed in a peripheral region of the drill string between an inner wall of the drill string and an outer wall of a neck region of a separator core, the inner wall of the drill string being substantially parallel to the outer wall of the separator core, wherein the at least one first outlet for releasing air from the separation chamber is disposed at an upper region of the separation chamber and the one or more second outlets is disposed at a lower or distal region of the separation chamber for releasing water from the separation chamber so that when in use water is inhibited from egress from the separation chamber through the first outlet, wherein air released from the first outlet lubricates bearings of a drill bit located at the drill bit attachment region.

2. The separator apparatus in accordance with claim 1 wherein the first outlet is disposed at a radially inward region of the separation chamber for releasing air from the separation chamber and the one or more second outlets are disposed at a radially outward region of the separation chamber for releasing water from the separation chamber so that when in use the water is inhibited from egress from the separation chamber through the first outlet.

3. The separator apparatus in accordance with claim 1 wherein the first outlet is disposed at an upper and radially inward portion of the separation chamber for releasing a separated air stream from the separation chamber and a second outlet disposed at a lower and radially outward portion of the separation chamber for releasing a discrete water stream from the separation chamber so that when in use water is inhibited from egress from the separation chamber through the first outlet.

4. The separator apparatus in accordance with claim 1 wherein the one or more second outlets are disposed at a base region of the separation chamber and the first outlet is a port disposed at an upper axial region relative thereto.

5. The separator apparatus in accordance with claim 1 wherein the inlet is disposed at a peripheral region of the separator body and includes a restriction so that in use the air/water stream is reduced in velocity upon reaching the separation chamber which converts the water into droplets.

6. The separator apparatus in accordance with claim 5 wherein the restriction is a venturi.

7. The separator apparatus in accordance with claim 1 wherein the first and second outlets are respectively, air and water outlet ports.

8. The separator apparatus in accordance with claim 7 wherein a nozzle is provided at the water outlet port so as to atomise the water issuing from the water outlet port.

9. The separator apparatus in accordance with claim 8 wherein the variable adjustment means is threaded and is integral with the nozzle.

10. The separator apparatus in accordance with claim 9 wherein the threaded nozzle is mounted in a side wall of the drill pipe.

11. The separator apparatus in accordance with claim 7 wherein the variable adjustment means includes a plug movable relative to a flange having one or more features or faces corresponding with the plug.

12. The separator apparatus in accordance with claim 11 wherein the water outlet port includes an aperture which is in the form of a space around the plug, being generally annular in shape.

13. The separator apparatus in accordance with claim 1 wherein the inlet is disposed at an upper annular region of the separator body.

14. The separator apparatus in accordance with claim 1 wherein the first outlet is in the form of an air outlet port and is disposed in an axial region of the separation chamber so that in use, when the drill pipe is rotating, water entry to the air outlet port is inhibited.

15. The separator apparatus in accordance with claim 1 wherein the separator body includes a core which includes walls or cowls extending therefrom to engage with the drill pipe wall to hold the separator body in place therein.

16. The separator apparatus in accordance with claim 1 wherein the separator body includes connector regions, being a first connector end to connect to the drill pipe and a second connector end to connect to a drill string.

17. The separator apparatus in accordance with claim 1 wherein at the first end of the separator apparatus, a core body is provided to connect to the drill string or pipe at the distal end of the drill string or pipe.

18. The separator apparatus in accordance with claim 1 wherein the core body includes core segments which operatively engage with the distal end of the drill pipe.

19. The separator apparatus in accordance with claim 18 wherein. the core segments are generally of a diameter similar to that of the inner diameter of the drill pipe, so that an interference fit is provided to operatively engage the drill string or pipe.

20. The separator apparatus in accordance with claim 1 wherein two core segments are provided, diametrically opposed to one another.

21. The separator apparatus in accordance with claim 1 wherein parts of the separation chamber are disposed in regions between shoulders of the core segments so as to assist with imparting a tangential velocity to the water droplets.

22. The separator apparatus in accordance with claim 1 wherein the connector region at the second end is a threaded bore so as to receive a drill bit.

23. The separator apparatus in accordance with claim 1 wherein the air outlet passage, axially disposed, is in fluid communication with the threaded bore so that the air may lubricate the bearings of the drill bit.

* * * * *